US005873392A

United States Patent [19]

Meyer et al.

[11] Patent Number: 5,873,392

[45] Date of Patent: Feb. 23, 1999

[54] PROCESS FOR MONITORING FAULTS IN TEXTILE WEBS

[75] Inventors: Urs Meyer, Zurick; Roland Seidl, Wattwil; Werner Frischknecht, St. Gallen; Markus Keusch, Heiden; Daniel Wick, Lütisburg, all of Switzerland

[73] Assignee: Retech Aktiengesellschaft H. Von Arx, Meisterschwanden, Switzerland

[21] Appl. No.: 640,784

[22] PCT Filed: Nov. 2, 1994

[86] PCT No.: PCT/EP94/03604

§ 371 Date: Jun. 24, 1996

§ 102(e) Date: Jun. 24, 1996

[87] PCT Pub. No.: WO95/14805

PCT Pub. Date: Jun. 1, 1995

[30] Foreign Application Priority Data

Nov. 24, 1993 [CH] Switzerland ..... 3503/93

[51] Int. Cl.[6] ..... D06H 3/00; D06H 1/00; D03J 1/00; D03J 1/20

[52] U.S. Cl. ..... 139/113; 83/76.8; 364/468.23; 364/470.14; 235/375

[58] Field of Search ..... 83/76.8, 76.6; 364/469, 470, 471, 550, 551.01, 468.17, 468.23, 470.14; 139/1 B; 73/159; 235/375

[56] References Cited

U.S. PATENT DOCUMENTS

| | | | |
|---|---|---|---|
| 3,038,233 | 6/1962 | Spunt . | |
| 3,251,112 | 5/1966 | Ingham, Jr. . | |
| 3,839,637 | 10/1974 | Willis . | |
| 4,146,061 | 3/1979 | Gotoh . | |
| 4,583,181 | 4/1986 | Gerber et al. | 364/470 |
| 4,744,035 | 5/1988 | Hashim | 364/470 |
| 5,001,331 | 3/1991 | Leestemaker | 235/375 |
| 5,166,874 | 11/1992 | Nomaru et al. | 364/468 |
| 5,341,304 | 8/1994 | Sakamoto et al. | 364/468 |

FOREIGN PATENT DOCUMENTS

| | | |
|---|---|---|
| 2070459 | 9/1971 | France . |
| 1227418 | 10/1966 | Germany . |
| 1961710 | 7/1970 | Germany . |
| 3401826 | 10/1985 | Germany . |
| 1456834 | 11/1976 | United Kingdom . |
| 2079682 | 1/1982 | United Kingdom . |

*Primary Examiner*—Andy Falik
*Attorney, Agent, or Firm*—Weingarten, Schurgin, Gagnebin & Hayes LLP

[57] ABSTRACT

A process for automated monitoring of faults occurring in textile webs. At least one marking is worked into the web under manufacture. The marking permits incremental measurement of the textile web and facilitates the determination of particular positions thereon. Web faults and other events are detected during manufacture and their positions stored electronically. Detected faults can then be efficiently located and examined using the electronically stored location coordinates and the marking. Since the marking is worked into the web, the location of the fault can be efficiently determined even at later stages in the manufacturing process.

29 Claims, 3 Drawing Sheets fill threads omitted
in edge zone structural changes in
edge zone

PROCESS FOR MONITORING FAULTS IN TEXTILE WEBS

BACKGROUND OF THE INVENTION

The faults which occur during the manufacture and finishing of textile webs are not completely avoidable. At the Textile Mill Colloquium, held in Denkendorf on Oct. 20–21, 1993, G. Besenreuther asserted that even today a textile web with a length of 120 meters, which exhibits from 12 to 15 faults, is considered the first choice. The fault number refers to a web coming from the mill, as supplied to a finisher for further processing. From the ready-made goods industry comes the requirement, however, that the number of faults for such a web must be reduced to less than 10.

The greater part of the faults arises during production of the web structure. The machine must be stopped immediately, if it produces a fault. This has already been achieved through extensive monitoring equipment: warp-thread monitors and woof checking during weaving, monitoring of the course of the yarn and needles in the case of knitting as well as the halting of the machine with an optical alarm belong to the state of the art. The machine operators remove the fault at the machine. The fault in the textile web can as a rule be removed only later, however, because it at the moment is not located at a point in the machine accessible to interventions. Although the information that a fault has occurred as well as its position are known, this information is however lost in the case of present-day manufacturing processes. Sometimes corresponding marking threads are of course inserted at those positions which stopped the machine, thus making finding them again easier.

In a special testing step, the so-called goods inspection, the web is checked by eye over its entire length on the show table. The faults are thereby removed insofar as possible, for example, by removing thread ends, trimming away knots, cleaning up stains and the like. The search for faults on the web imposes great demands upon the attention of the personnel.

A system is marketed under the name Wisotex by the firm, Zellweger AG, to automate the search for faults. This system includes a video camera with optical image recognition, which marks the faults discovered. The marked positions are then checked during the goods inspection and removed insofar as possible. All the markings are then removed, and the corresponding information is thus lost. The markings must be removed, however, in order not to cause later faults during the finishing of the web. Due to the high cost factor and deficient reliability, this system has not however been successful in the marketplace. This is not astounding, if one is acquainted with the multitude of possible web-fault types which can occur. Reference is made in this context to the *Katalog der Gewebefehlerarten im Rohgewebe* [Catalogue of the Types of Web Faults in the Raw Weave], published by the International Textile Service, Ltd., Schlieren, Switzerland, 1989.

U.S. Pat. No. 4,146,061 (Nissan Motor Corporation) is concerned with the faults occurring at the loom. The detection of faults is limited to breaks in the warp and fill threads, which are determined by the loom itself. In addition, length markings are woven into the web edge, which are based upon the absolute length measurement. The resulting data can be reproducibly employed during the first goods inspection and are thereafter lost.

In the layer processing stages of finishing, the following steps are repeated: stopping the machine at a process fault, removal of the operational disturbance, goods inspection on completion of the process, with removal of faults according to the best option. The effort devoted to this depends upon the type of process step and the value of the web. As a rule, but at least before delivery to the stage where tailored articles are produced, another goods inspection is carried out. In each subsequent goods inspection, the faults present and the additional ones must be reevaluated and removed if possible.

Of immediate importance is also the direct measurement of the change in the length of the web during finishing. The shrinkage or stretching of the textile surface is a significant parameter and a sensitive indicator for the consistency of many processes during finishing. A measurement of the current length of the web at any arbitrarily selected point in the process permits a series of improvements in processing precision.

A significant amount of scrap arises during the processing of the textile surface on the cutting table. With an efficient layout of the individual pieces, it is possible to keep the quantity of scrap to a minimum. This layout, according to the current state of the art, presupposes a textile web which is free of faults. If the textile surface contains a fault, various options arise, for taking it into account. If the cut is not adjusted, the spot with the fault must be discarded after cutting.

An entire series of parts thus becomes unusable, and the parts in question must be identified and found. It is also possible to submit the cutting with the fault to further processing and remove the finished product from the line to be sold as a second. Most widespread is that method where the faulty part of the web is cut out over its entire width. But if cutting is adjusted to leave the zone with the fault outside the area used, the quantity of scrap is significantly reduced. This option would be indeed feasible in the case of completely automated and computerized layout procedures, but requires precise information relative to the position of the fault in the textile web.

SUMMARY OF THE INVENTION

It is consequently the goal of the present invention to create a process which makes possible the completely automated monitoring of faults in textile webs.

This objective is achieved by a process which is distinguished by the fact that markings are worked into the textile web, permitting an incremental measurement of the textile web, and that a specific textile-web file is created on an electronic data-storage medium during finishing and further processing of the textile web, which contains the production-specific data and all the occurring production faults, along with the marking data.

The creation of a specific web file in the form of an electronic data medium is already today state of the art. This web file nowadays however stays with the corresponding production plant. By working the markings into the web, it is possible for the first time to create a link between the web and the web file, which makes it possible to pass the web file along with the web and to supplement and make further use of the obtained information in each subsequent step.

BRIEF DESCRIPTION OF THE DRAWINGS

Referring to the enclosed drawing, the invention is explained conceptually and in its numerous execution variants with the help of the following description. Appearing in.

DETAILED DESCRIPTION OF THE DRAWINGS

Figure 1:
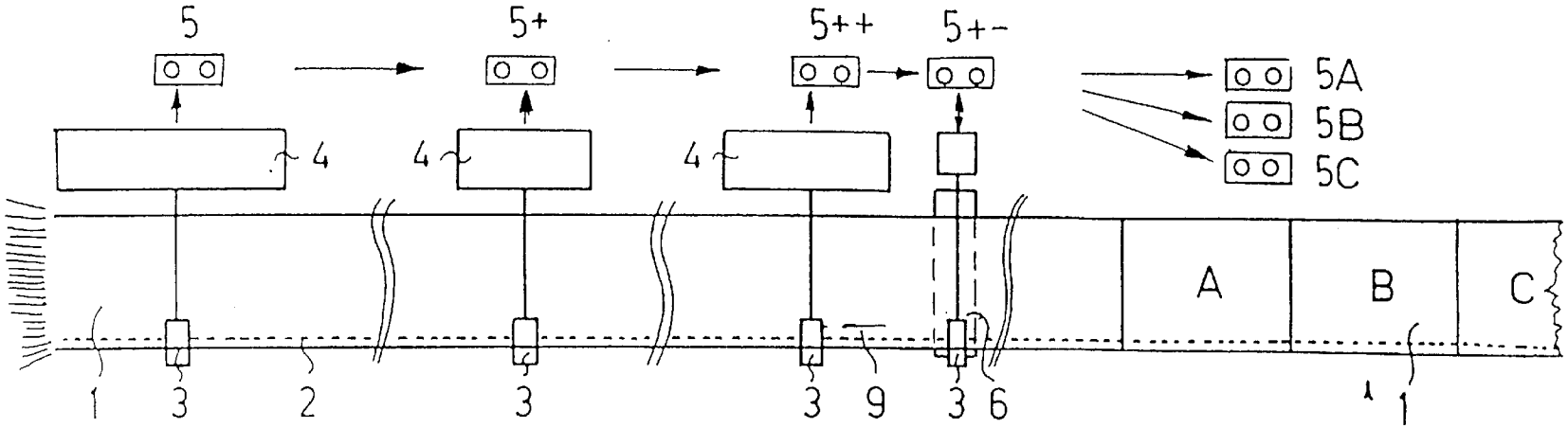
FIG. 1 is a schematic drawing of the manufacture and processing of a textile web and the linking of information as well as FIG. 2 the utilization of the data in a plant for the production of tailored articles.

The essence of the invention consists of the fact that a marking is worked into a web to be manufactured and further processed, which permits an incremental measurement of the web and correspondingly links events to their position, storing the event data relative to the event and its position in a web file. The web, symbolically represented in the flow of production, is labeled with 1. Markings are continuously being worked into this web. These markings form at least a sort of continuous measurement strip which is inseparably linked to the web. By means of corresponding sensors 3, the markings 2 can be read and thus yield the circumstance data linked to the web 1. Each machine stop of each production machine or processing station 4 as well as further production data with an influence upon the web 1 are stored in a web file 5. The web file 5 is passed along from each stage of production to the next production stage with the web 1, or forwarded in the form of data transmissions. In the next production step, additional data are added to the web file 5, these data too being stored, linked to the indication of the position, which can be read from the markings 2. Correspondingly arising is a subsequent web file 5+ or 5++, etc.

Following certain production steps, the web 1 is passed over a show table 6. The advance of the web 1 on the show table 6 takes place under the control of the web file 5. As soon as a recorded fault with position data is detected, and the recognition sensor 3 has verified the position from the continuous markings, the advance of the web 1 is brought to a halt, so that the detected fault will lie directly in front of the operator. The latter evaluates the fault, whose type can for example be indicated on a display, and removes it insofar as possible. Following that, the operator receipts the fault and deletes it from the web file, if he or she was able to remove it, or marks the fault as not removable. The web file is then correspondingly designated with 5+−.

Such a goods inspection can obviously take place not only at one place, as indicated in the drawing, but after each web production and further-processing stage. This will largely depend upon whether and when various faults can best be removed.

When the manufacture and the finishing of the web are complete, it is frequently divided into various segments A, B and C.

These parting positions can likewise be marked on the web. If the web segments then go various ways under certain circumstances, a corresponding web-file copy 5A, 5B, 5C will be made for each web segment. The copies of the web file can be sent together with the web segments, or merely forwarded separately to the next station by data transmission, Such further stations include, for example, sizing works, dying works, coating companies or manufacturers of tailored articles.

Figure 2:
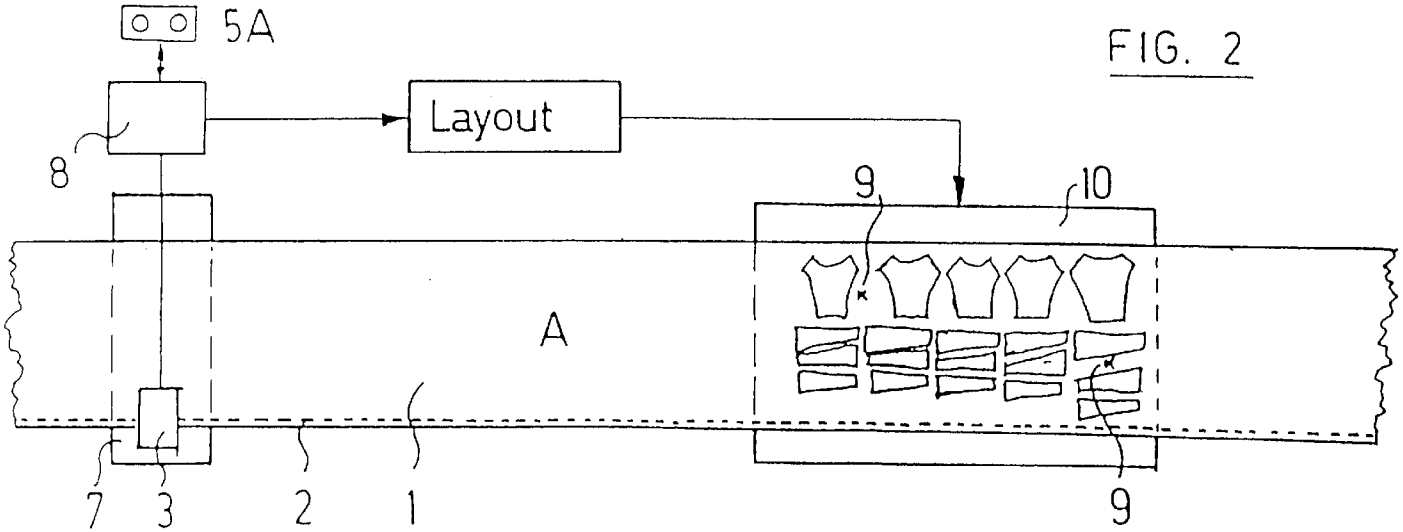
Figure 3:
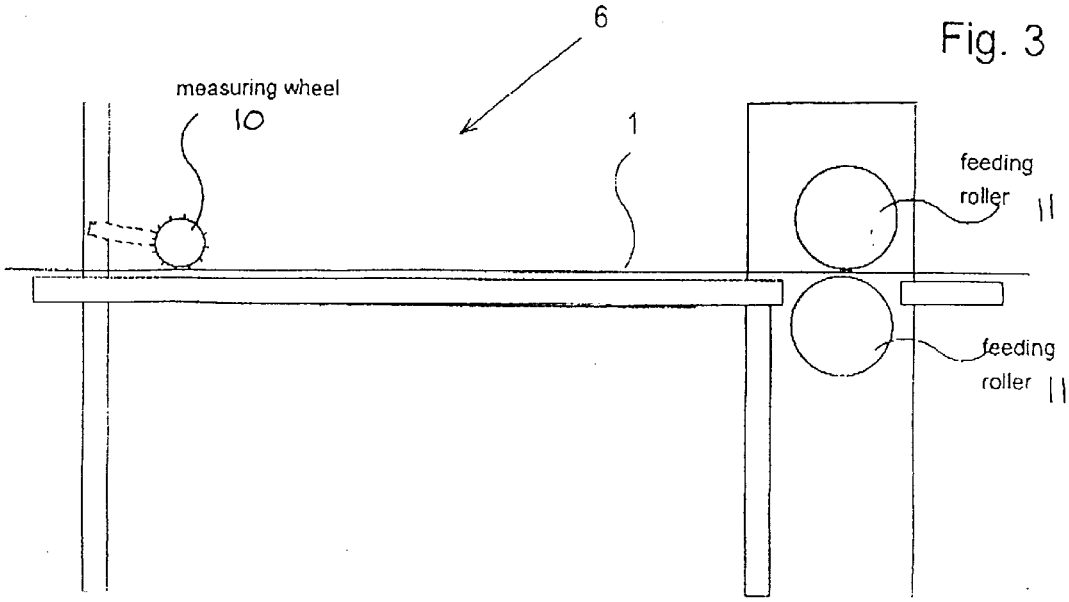
FIG. 3 is a side view of the apparatus of FIG. 1.

Such additional processing in a plant for the production of tailored articles is shown schematically in FIG. 2. The web file 5A is, for example, entered into a central data bank and a web segment for cutting delivered. Here, too, a recognition sensor 3 is provided, which reads the available marking 2 as before. The individual web segments A, B, C can be provided with identification labels already when being cut to size, whose identification mark is also stored in the corresponding, associated web file. If this identification is thus read before cutting to size, the computer will then be immediately able to find the corresponding web file again.

More convenient, however, is that variant where the markings 2 contain not only position data, but also web identification signals along with them. In this case, any desired web segment can be laid on an identification table 7, where the recognition sensor 3 will read the marking 2 and send the corresponding identification signal to the computer 8 which immediately locates the corrected web file. The computer takes all data relative to the faults present from the web file 5A and then arranges the layout in such a way that no fault 9 will fall within a cutting. The web 1, finally, will be used on the automatic cutting machine 10 in such a way that the work can proceed with minimal waste and the most extensive possible utilization of the satisfactory portion of the web. The various options for marking the web per the teaching of the invention will now be described in detail below. Whereas the description thus far has been concerned essentially with the markings on the web representing linkage with the data and with the web file, the focus will now be upon the markings only. First of all, the markings can occur at regular intervals remaining always the same. The information content of such a marking corresponds to the unit markings on a ruler. Read continuously and added, each marking yields an exact position in the lengthwise direction of the web.

If the web is not later cut up into web segments, such marking is quite adequate. Such marking with distance is the simplest option in manufacture. In many case, however, such marking might not be adequate for later requirements. If the corresponding segmental parts can thus no longer be recognized, the production direction of the web can likewise no longer be determined. And, when the web is cut up into web segments, the corresponding position data will also be absolutely lost, if these data are not transferred to the web file in some way or manner. Nevertheless, it is also possible in these cases to work with simple, regular marking, though the corresponding data, such as identification of the web, position of parting and running direction, must be entered on a separate label which is attached to the web and delivered along with it.

Figure 4:
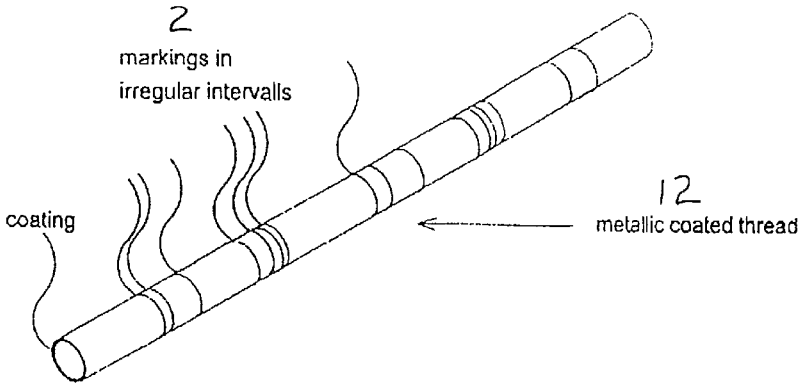
FIG. 4 is an isometric view of a metal coated warp thread.

All this additional information can be forwarded much more simply by providing the web with irregularly spaced markings as shown in FIG. 4. The irregular pattern of the markings yields a sort of fingerprint which can be read and compared with the stored marking patterns. Such irregular markings can be produced with a random-number generator.

Each web thus gives rise to a unique pattern, permitting unequivocal identification at all times. In this way, each position on the web, viewed not only relatively, but absolutely, can also be found again. Even the running direction of a web segment can be later determined at any time. If a certain marking sequence is not found, it can be assumed that the web segment is being scanned in the direction opposite to that of the running direction. But if the running direction of the web is in itself of no importance, the software can be so designed that a series of markings is scanned in sufficient number and compared with stored data. If no agreement is found, the sequence is reversed and the comparison repeated.

It is also possible to employ supplementary markings at regular intervals in addition to the irregular markings which are not repeated. This further permits determination of a relative position and thus also a length measurement in addition to the absolute position determination.

Thanks to these means, the shrinkage or stretching of a web can be determined during various processing steps completely automatically, for example, by passing the web over a roller to determine the actual dimensions, while the regular markings are being simultaneously read by means of a recognition sensor and the nominal value thereby obtained. By the corresponding comparison of these two values, a computer can automatically determine the degree to which the web has shrunk or stretched, using these data in turn to control the machine.

Independently of whether the textile web is present as a woven or nonwoven product, the markings can be advantageously arranged in the edge region of the textile web. A large number of different options is available, especially if the markings are incorporated in the form of structural changes. Such changes in structure cannot only be applied at regular or irregular intervals, but they can, instead of or in addition to this, also have different forms. This automatically increases the quantity of information which can be delivered by the use of these markings.

Figure 5A:
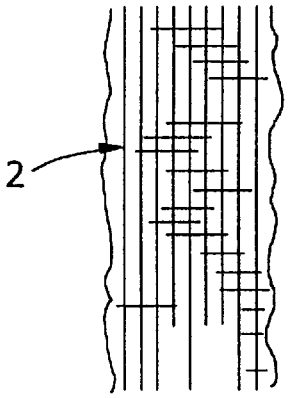
FIG. 5A is a diagram of fill threads.
Figure 5B:
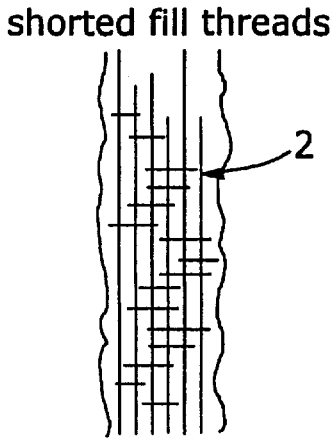
FIG. 5B is a diagram of shorted fill threads.
Figure 5C:
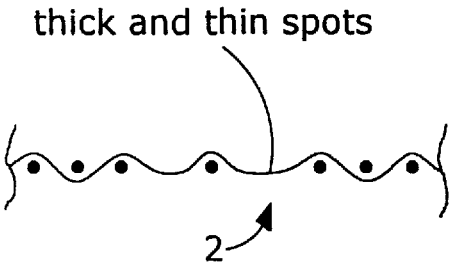
FIG. 5C is a diagram of thick and thin spots on an edge of the web.
Figure 5D:
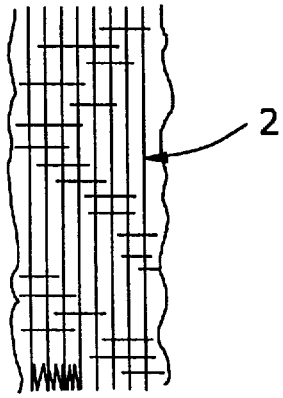
FIG. 5D is a diagram of structural changes in the edge zone of a web.

If the textile web is a woven product, the structural changes can be generated in the edge zone by weaving technology as shown in FIG. 5D. This can be achieved already with conventional looms. An example of such weaving-technological measures consists of changing the binding in the edge zone. But even the embedding or insertion of short threads, as shown in FIG. 5B, running in the direction of the fill can lead to the generation of the desired structural changes which serve as markings. If the embedding length of the filling threads is varied, structural changes in the edge zone are achieved with weaving technology, which are easily recognizable. A further variant shown in FIG. 5A consists of omitting fill threads in the edge zone at desired, preset intervals. This, too, generates a structural change in the web, which is easily detectable. A special form of such markings can also be produced by shortening the fill threads in a graded sequence at regular intervals.

Although the markings are thus achieved in the examples described above by means of weaving techniques with yarn running in the direction of the woof, it is obviously also possible to produced the markings by means of warp yarn.

Here, too, it is again advantageous to work in the edge region of the web. This can also be accomplished by means of weaving technology, for example, by twisting two or more warp threads lying alongside each other between two sequential fill threads. The use of a warp thread as an information carrier likewise permits various execution variants. Thus, for example, a warp yarn can exhibit thick or thin spots at specified intervals, which can serve as markings as shown in FIG. 5C. Such yarns are obtainable commercially under the designation of effect yarns. An especially advantageous execution variant consists of working in at lease one warp yarn made of metal, to which magnetic markings are applied. Such a yarn can be specially prepared, and of course in such a way that it is able to accept a particularly large quantity of data. Such a warp yarn can thus be provided already during its manufacture by the corresponding arrangement of markings with basic information. Such data, for example, can include a continuous numeration in the form of code sequences. A further solution consists of warp yarns exhibiting magnetizable properties. A warp yarn of this type can be marked electromagnetically during production.

The warp yarns needs by no means to be a purely metallic thread, but can, for example, be a mono- or multifilament thread with a metallic coating 12 as shown in FIG. 4. The corresponding markings can then, for example, consist of the sequence of coated and uncoated thread segments. Last of all, yarns are however known, in which radioactive material is embedded. Such a warp yarn is likewise excellently suitable as a corresponding marking. A thread made of radioactive material can also however be utilized for fill threads. A corresponding sensor can then directly determine the interval between two active materials. But in the clothing industry this solution will probably not seem attractive.

According to the type of the markings, these can be detected by various means. Most of the structural changes introduced via weaving technology, which serve as markings, can be detected by purely mechanical means. But it is however just as possible to detect the majority of these markings optically. However when the markings are present in magnetic form, they must of course be detected electromagnetically.

Particularly in the case of markings at regular intervals, it will be desirable under certain circumstances to produce relatively large intervals between neighboring markings. To permit an exact position determination to be nevertheless possible, length measurement can be additionally combined with conventional means, for example, a measuring wheel 10 or a feeding roller 11. The combination of these two measurement methods, namely, by means of marking on the one hand and, on the other, via the purely mechanical measurement of revolution, again however permits determination of a stretching or shrinkage of the textile web. This results from the preset nominal-value distance between two markings and the actual value, which is determined mechanically. Such an interpolation between two markings can also be produced, in the case of magnetic markings, via the determination between two markings by measuring their respective field strengths at a specific point.

When working with a warp thread doped with radioactive material, the corresponding sensor must obviously be a radiation detector. If the radioactive material is present in fill threads with relatively large intervals, corresponding pulses can be counted with a radiation detector.

If however the warp thread is doped with radioactive material, the quantity of radiation can be detected by summing as the web passes by, thus yielding position data. Although, with that, surely not all conceivable variants of the invention have been discussed, already these examples demonstrate the enormous diversity of the invented solutions.

The importance of the invention for the textile industry and the corresponding application possibilities can scarcely be completely grasped at the present point in time.

What is claimed is:

1. A process for monitoring faults in a textile web through several stages of production, comprising the steps of:

providing a plurality of markings in a web, detecting a fault in said web of textile material during manufacture and further processing, correlating the position of said fault to one or more of said markings;

recording in a web file the data related to the fault and the correlation of one or more of the markings on an electronic data-storage medium; and providing said web file along with the web to a respective next production stage.

2. The process according to claim 1, further comprising the step of recording any faults determined anew at each stage of production in the web file in conjunction with one or more of said plurality of markings.

3. The process according to claim 2, further comprising the step of utilizing a measuring wheel for determining the position between two of the markings.

4. The process according to claim 2, further comprising the step of utilizing a feeding roller for determining the position between two of the markings.

5. The process according to claim 1, wherein said step of providing a plurality of markings further comprises the step of arranging the markings in regular intervals.

6. The process according to claim 1, wherein said step of providing a plurality of markings further comprises the step of arranging the markings in irregular intervals, said markings containing further information for identification in addition to the position of said fault.

7. The process according to claim 1, wherein said step of providing a plurality of markings further comprises the step of inserting structural changes of irregular form, serving as said markings, in an edge zone of the textile web at regular intervals.

8. The process according to claim 1, wherein said step of providing a plurality of markings further comprises inserting structural changes, serving as said markings, in an edge zone of the textile web with irregular intervals and/or form.

9. A process according to claim 8 for woven textile webs wherein the step of inserting structural changes in the edge zones is accomplished by means of weaving-technological measures.

10. The process according to claim 7, for woven textile webs, wherein said step of inserting structural changes comprises the step of generating the structural changes in the edge zones by means of weaving-technological measures.

11. The process according to claim 10, wherein said weaving-technological measure comprises changing the binding in the edge zone.

12. The process according to claim 10, wherein the step of generating the structural changes comprises the step of inserting in the edge zone short threads in a fill direction as markings.

13. The process according to claim 10, wherein the step of generating structural changes comprises the step of changing the insertion length of fill threads in the edge zone.

14. The process according to claim 13, wherein the step of generating structural changes comprises the step of omitting the fill threads in the edge zone at preset intervals.

15. The process according to claim 12, wherein the step of generating the structural changes comprises the step of shortening the fill threads, at regular intervals, in a graded sequence.

16. The process according to claim 10, further comprising the step of inserting a warp yarn in the edge zone, which exhibits thick and thin spots at preset intervals, which serve as said markings.

17. The process according to claim 1, further comprising the step of inserting at least one warp thread made of metal into the web, said warp thread having the markings magnetically applied thereto.

18. The process according to claim 1, wherein the step of providing a plurality of markings comprises the step of inserting a warp thread with magnetic properties into the web, said warp thread provided with the markings for incremental measurement during the stages of production.

19. The process according to claim 18, further comprising the step of detecting the markings electromagnetically.

20. The process according to claim 1, wherein the step of providing a plurality of markings comprises the step of inserting into the web at least one warp thread, the at least one warp thread having a metallic coating which includes the markings.

21. The process according to claim 20, further comprising the step of detecting the markings electromagnetically.

22. The process according to claim 1, wherein the step of providing a plurality of markings comprises the step of inserting a thread doped with radioactive material into the textile web.

23. The process according to claim 1, further comprising the step of reading from units positioned at various points in the stages of production, finishing, goods inspection and further processing, corresponding position data with the aid of the markings and forwarding said corresponding position data to data processing, which combines said corresponding position data with fault reports in the web file.

24. The process according to claim 23, further comprising the step of stopping an advance of said web at points in which fault reports were previously generated which correlate with the markings read during the goods inspection and compared with the data stored in the web file.

25. The process according to claim 23, further comprising the step of deleting faults from the web file when said faults are removed during the goods inspection.

26. The process according to claim 1, further comprising the step of providing the markings, at least at the beginning or the end zone of the textile web, the markings being provided in a pattern which yields a web-identification code.

27. The process according to claim 1, further comprising the step of measuring an actual distance between two specific markings before a finishing step and determining the expansion or shrinkage of the web from the resulting data.

28. The process according to claim 1, further comprising the step of reading the markings during a goods inspection and comparing the markings with the data stored in the web file, and stopping an advance of the web at those points at which fault reports were generated during production or finishing.

29. The process according to claim 1, further comprising the step of deleting a fault from the web file when said fault is removed during the goods inspection.

* * * * *

UNITED STATES PATENT AND TRADEMARK OFFICE
CERTIFICATE OF CORRECTION

PATENT NO : 5,873,392
DATED : February 23, 1999
INVENTOR(S) : Meyer, et al.

It is certified that error appears in the above-identified patent and that said Letters Patent are hereby corrected as shown below:

Front page, Title [54], "PROCESS FOR MONITORING FAULTS IN TEXTILE WEBS", should read --A PROCESS FOR PROVIDING AND DETECTING MARKINGS FOR MONITORING FAULTS IN TEXTILE WEBS--; and Column 1, lines 1 and 2, "PROCESS FOR MONITORING FAULTS IN TEXTILE WEBS", should read --A PROCESS FOR PROVIDING AND DETECTING MARKINGS FOR MONITORING FAULTS IN TEXTILE WEBS--.

Signed and Sealed this

Eighth Day of May, 2001

*Attest:*

Nicholas P. Godici

NICHOLAS P. GODICI

*Attesting Officer*

*Acting Director of the United States Patent and Trademark Office*